US005122084A

United States Patent [19]

Lieb et al.

[11] Patent Number: 5,122,084

[45] Date of Patent: Jun. 16, 1992

[54] APPARATUS FOR ASSISTING TRANSMISSION SHIFTING IN A MARINE PROPULSION DEVICE

[75] Inventors: M. Jeremy Lieb, Northbrook; Anthony P. Prince, Waukegan; Stanley W. Nerstrom, Zion, all of Ill.

[73] Assignee: Outboard Marine Corporation, Waukegan, Ill.

[21] Appl. No.: 396,123

[22] Filed: Aug. 21, 1989

[51] Int. Cl.[5] ..... B60K 41/00

[52] U.S. Cl. ..... 440/86

[58] Field of Search ..... 440/1, 84, 86; 74/851, 74/852, 879

[56] References Cited

U.S. PATENT DOCUMENTS

| | | | |
|---|---|---|---|
| 3,135,234 | 6/1964 | Turnidge | 440/87 |
| 3,602,181 | 8/1971 | Harris | 114/153 |
| 4,215,596 | 8/1980 | Long | 74/851 |
| 4,232,771 | 11/1980 | Prince | 192/0.096 |
| 4,262,622 | 4/1981 | Dretzka | 440/1 |
| 4,403,970 | 9/1983 | Dretzka et al. | 440/75 |
| 4,432,734 | 2/1984 | Bland et al. | 440/1 |
| 4,525,149 | 6/1985 | Broughton et al. | 440/1 |
| 4,753,618 | 6/1988 | Entringer | 440/86 |
| 4,838,822 | 6/1989 | Friedle et al. | 74/851 |

FOREIGN PATENT DOCUMENTS 2213214 9/1989 United Kingdom .

*Primary Examiner*—Jesus D. Sotelo

*Attorney, Agent, or Firm*—Michael, Best & Friedrich

[57] ABSTRACT

Disclosed herein is an apparatus for assisting transmission shifting in a marine propulsion device having an internal combustion engine including an ignition system, the transmission being shiftable between a neutral condition and a drive condition, which apparatus comprises a shift lever mounted remotely from the engine and operably connected with the transmission for shifting the transmission between the drive position and the neutral position, a normally closed switch mounted on said shifting lever and connected with the ignition system for interrupting operation of the ignition system in response to movement of the shift lever from the drive position to the neutral position, and an actuator moveably mounted on the shifting lever for actuating the normally closed switch in response to movement of the shift lever from the drive position to the neutral position.

19 Claims, 1 Drawing Sheet

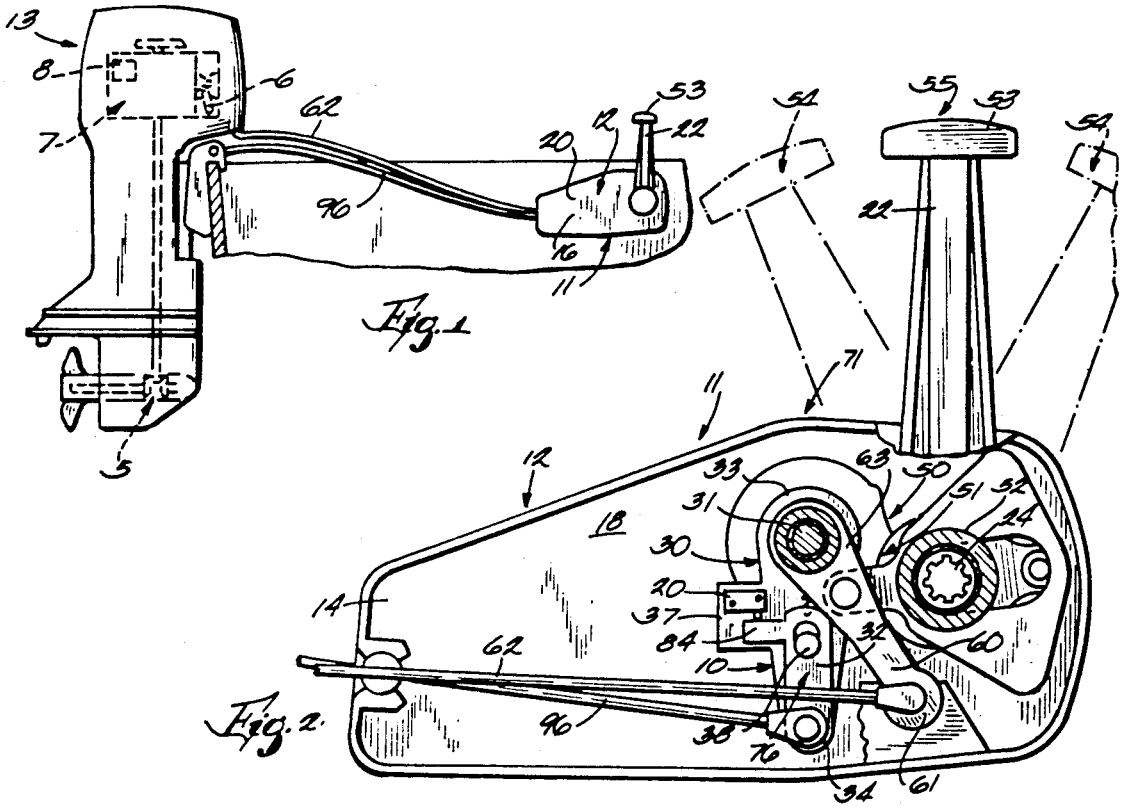
Fig. 1
Fig. 2.
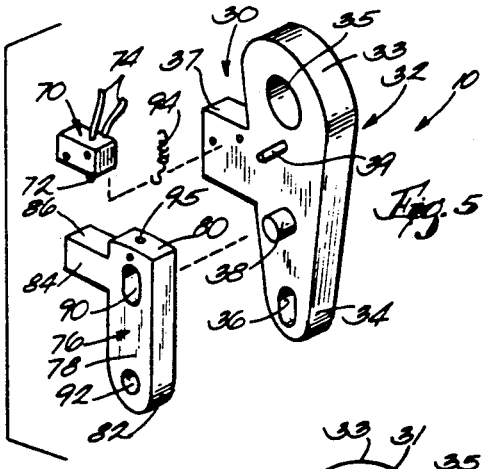
Fig. 5
Fig. 3
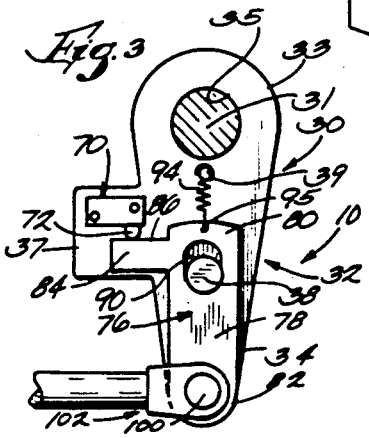
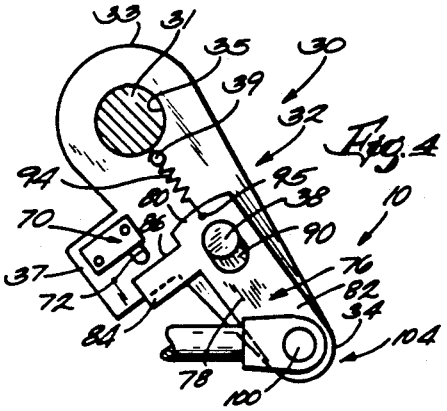
Fig. 4

APPARATUS FOR ASSISTING TRANSMISSION SHIFTING IN A MARINE PROPULSION DEVICE

BACKGROUND OF THE INVENTION

1. Field of the Invention

The invention relates generally to single lever controls for regulating the throttle and transmission associated with an internal combustion engine. More specifically, the invention relates to a single lever control for marine propulsion devices such as outboard motors and stern drive units, which control can be manually manipulated for shifting the transmission between a neutral condition and a drive condition, and which interrupts the engine ignition in response to shifting the transmission to thereby assist transmission shifting.

2. Reference to the Prior Art

Attention is directed to the U.S. Pat. No. 4,215,596 which issued on Aug. 5, 1980 and which relates to a gear shift lever assembly having ignition system deenergizing means, to U.S. Pat. No. 4,232,771 which issued on Nov. 11, 1980 and which relates to a single lever remote control, to U.S. Pat. No. 4,262,622 issued on Apr. 21, 1981, to U.S. Pat. No. 4,432,734 issued on Feb. 21, 1984, and to U.S. Pat. No. 4,525,149 issued on Jun. 25, 1985, all of which relate to marine propulsion devices including ignition interruption means to assist transmission shifting.

SUMMARY OF THE INVENTION

The marine propulsion device of the present invention includes an internal combustion engine having an ignition and a transmission shiftable between a neutral and a drive condition, a control located remotely from the engine and operable to control shifting of the transmission between the neutral condition and the drive condition, and means on the control and operably connected to the ignition system for interrupting engine ignition in response to shifting the transmission from the drive condition to the neutral condition.

The invention also provides an apparatus for assisting transmission shifting in a marine propulsion device having an internal combustion engine including an ignition system, the transmission being shiftable between a neutral condition and a drive condition, the apparatus comprising a shift lever adapted to be mounted remotely from the engine and operably connected with the transmission for shifting the transmission between the drive position and the neutral position, means on the shifting lever and connected with the ignition system for interrupting operation of the ignition system, and means moveably mounted on the shifting lever for actuating the interruption means in response to movement of the shift lever from the drive position to the neutral position.

The invention further provides a marine propulsion device including an internal combustion engine including an ignition system, a transmission drivingly connected to the internal combustion engine and shiftable between a drive position and a neutral position, a shift lever adapted to be mounted on a boat for pivotal movement relative thereto and operably connected with the transmission for shifting the transmission between the drive position and the neutral position, a switch fixed on the shift lever for interrupting the operation of the ignition system in response to movement of the shift lever from the drive position to the neutral position, an actuator adapted to be mounted on the shift lever for movement away from the switch in response to movement of the shift lever from the drive position to the neutral position, and means mounted on the shift lever for releaseably holding the actuator against movement relative to the switch in response to movement of the shift lever from the neutral position to the drive position.

Other features and advantages of the invention will become apparent to those skilled in the art upon review of the following detailed description, claims, and drawings.

THE DRAWINGS

FIG. 1 is a partial side elevational view of a boat mounted marine propulsion device incorporating various features of the invention.

FIG. 2 is a somewhat enlarged fragmentary, longitudinal, vertical sectional view of a single lever control incorporating various features of the present invention taken from a position along line 2—2 of FIG. 1.

FIG. 3 is a somewhat enlarged, fragmentary, side elevation view of a portion of the marine propulsion device of FIG. 2 shown in a first position.

FIG. 4 is a somewhat enlarged, fragmentary, side elevation view of a portion of the marine propulsion device of FIG. 2 shown in a second position.

FIG. 5 is a somewhat enlarged, fragmentary, exploded perspective view of a portion of the marine propulsion device shown in FIG. 2.

Before one embodiment of the invention is explained in detail, it is to be understood that the invention is not limited in its application to the details of the construction and arrangements of the components set forth in the following description or illustrated in the drawings. The invention is capable of other embodiments and of being practiced or being carried out in various ways. Also, it is to be understood that the phraseology and terminology used herein is for purposes of description and should not be regarded as limiting.

DESCRIPTION OF A PREFERRED EMBODIMENT

The apparatus for assisting transmission shifting in a marine propulsion device is generally indicated by the numeral 10 in FIG. 2. Shown in the drawings is a single lever control 11 for operating a transmission 5 and throttle 6 of a remotely located marine propulsion device such as an outboard motor 13. Similarly this device could be utilized in connection with a stern drive unit (not shown). The outboard motor 13 includes an internal combustion engine 7, a transmission 5, and an ignition system 8. The single lever control 11 includes (see FIG. 2) a housing 12 comprised of opposed cover halves or sections 14 and 16, respectively, which include respective side walls 18 and 20 and which are suitably fastened together to form the generally closed housing 12.

The single lever control 11 also includes a main control lever 22 extending exteriorly of the housing 12 for both pivotal or rotational movement and lateral or axial movement relative to the housing 12. Provided in part for this purpose (see FIG. 2) is a shaft member 24 having outer ends which are journaled in bearings (not shown). The shaft member 24 is suitably connected to the lower end of the main control lever 22 for both rotation and common lateral or axial movement therewith.

Clutch or transmission control is provided by (see FIGS. 2, 3 and 4) a shift arm or lever 30 which is pivotally mounted on a stud or boss 31 which extends from the cover section 14. The shift lever 30 has an elongated, somewhat generally frusto-triangular shaped main body 32 including first and second ends 33 and 34, respectively. An aperture 35 is located adjacent the first end 33 and the stud 31 extends therethrough. An elongated aperture 36 is located adjacent the second end 34 and is oriented substantially longitudinally or in lengthwise relation relative to the elongated main body 32 of the shift lever 30 (see FIG. 5). The shift lever 30 further includes an arm member 37 which is positioned in substantially the same plane as the main body 32 and which is located between the first and second ends 33 and 34 of the main body 32. (See FIG. 3.) A post or shaft 38 is fixed on the elongated main body 32 and is positioned in substantially right angular relation therewith. The post 38 is located between the aperture 35 and the elongated aperture 36. A pin 39 is fixed on the elongated main body 32 and is located adjacent the aperture 35.

The shift lever 30 includes a gear segment 50 which meshes with a cooperating gear segment 51 provided on a shift drive member 52 which is mounted on the shaft member 24 for rotation between a neutral position and a shift position. As explained in more detail below, rotational movement of the main control lever 22 by manual manipulation of the outer end 53, from a drive position 54 (shown in phantom outline), to a neutral position 55 (shown in full lines), serves to rock the shift lever 30 about its pivotal mounting and thereby actuates the remotely located clutch or transmission appropriately. The drive position includes two drive positions which correspond to forward and rearward motion, and which are shown in phantom lines.

Throttle control is provided by (see FIG. 2) a throttle arm or lever 60 which, at its lower end 61, is adapted for connection to a push-pull cable 62 which is operatively connected to a remotely located engine throttle 6. The upper end of the throttle member is mounted for pivotal movement about an axis fixed relative to the housing 12 such as on a stud or boss (not shown) extending from the cover section 16 coaxially with the stud 31 on the cover 14. The operation of the throttle control is set forth in Prince U.S. Pat. No. 4,232,771, and therefore is not discussed in further detail herein.

Means are provided on the shift lever 30 and connected with the ignition system for interrupting the operation of the ignition system in response to movement of the shift lever from a drive position to a neutral position. While various arrangements can be used, in the specific construction illustrated, such means includes (see FIGS. 2 and 3) a normally closed switch 70 including a moveable contact 72. A pair of wires 74 operably connect the normally closed switch with the ignition which is located remotely on the outboard motor 13.

Means are provided on the shifting lever 30 for actuating the interruption means in response to movement of the shift lever from the drive position to the neutral position. While various arrangements can be used, in the specific construction illustrated, such means includes (see FIG. 2) a movably mounted actuator 76 having an elongated main body 78 with first and second ends 80 and 82, respectively. The elongated main body 78 further includes an arm member 84 which is disposed in substantially the same plane as the elongated main body 78, which is positioned adjacent to the first end 80, and which is further located adjacent to the normally closed switch 70. The arm member 84 has an upper edge 86 which is adapted to operably engage the moveable contact 72 of the normally closed switch 70. The elongated main body 78 further includes an elongated aperture 90 which is located on the first end 80, which is oriented substantially longitudinally, or in lengthwise relation relative to the main body 78 of the actuator, and which receives the Post 38. The actuator 76 further includes an aperture 92 located on the second end 82 of the actuator 76. When the apparatus 10 is assembled, the aperture 92 is disposed in substantial registry with the elongated aperture 36 which is formed in the second end 34 of the shift lever 30 (see FIG. 5).

The apparatus 10 also includes means on the shift lever 30 and on the actuator 76 for holding the actuator 76 against movement relative to the normally closed switch 70. While various arrangements can be used, in the specific construction illustrated, such means (see FIG. 3) includes a spring 94. One end of the spring is connected to the pin 39 on the shift lever 30 and the opposite end of the spring is connected to the first end 80 of the actuator 76 by engaging a small aperture 95.

The apparatus 10 also includes means mounted on an attachment pin 100 for moving an actuator 76 out of operative contact with the normally closed switch 70 when the shift lever 30 is moved from the drive position 54 to the neutral position 55. While various arrangements can be used, in the specific construction illustrated, such means includes a shift cable 96 which has opposite ends, and which operatively connects the shift lever 30 with the transmission 5. One end of the shift cable 96 is pivotally mounted on the second end 34 of the shift lever 30 by the attachment pin 100 which extends through the elongated aperture 36 formed in the second end 34 of the shift lever 30 and through the aperture 92 which is located on the second end 82 of the actuator 76.

In operation, the cable 96 resists movement, and in response to movement of the shift lever 30 from the neutral position 102 (see FIG. 3) to the drive position 104 (see FIG. 4), the spring 94 maintains the actuator 76 in a position wherein the actuator arm 84 remains in operative contact with the moveable contact 72 of the normally closed switch 70. When the actuator 76 is in this position, engine ignition is not effected. However, the cable 96, in response to movement of the shift lever 30 from the drive position 104 (see FIG. 4) to the neutral position 102 (see FIG. 3) overcomes the effect of the spring 94 thereby causing lengthwise movement of actuator 76 relative to the shift lever and thereby locates the actuator arm 84 in spaced relation relative to the normally closed switch 70 (see FIG. 4). When the actuator 76 is in this position, the normally closed switch opens, thus interrupting engine ignition and assisting transmission shifting. The effect of the cable is momentary and occurs only while the shift lever is moving from the drive position to the neutral position. When the shift lever assumes the neutral position, the spring 94 moves the actuator 76 and its accompanying actuator arm 84 lengthwise relative to the actuator 76 and into operative contact with the normally closed switch 76. In this position, engine ignition is not effected, as earlier discussed.

Various of the features of the invention are set forth in the following claims.

We claim:

1. A single lever control for a marine propulsion device including an internal combustion engine having a throttle, an ignition, and a transmission shiftable between a neutral and a drive condition, said single lever control being adapted to be located remotely from said marine propulsion device and including a housing, a shaft member supported within said housing for rotation relative to said housing, a control lever connected to said shaft member for common rotation therewith relative to a neutral position, an engine speed control member mounted on said housing and connected with said control lever for movement between a low speed position and a high speed position and connected to said engine throttle for controlling engine speed in response to rotational movement of the control lever from the neutral position, a shift lever mounted on said housing and connected with said control lever for movement between a neutral position and a drive position and connected to said transmission for operably shifting said transmission between the neutral condition and the drive condition in response to rotational movement of said control lever from the neutral position, and means on said single lever control and operably connected to said ignition for interrupting engine ignition in response to movement of said control lever relative to the neutral position.

2. An apparatus for assisting shifting of a marine propulsion device including an internal combustion engine having a throttle, an ignition system, and a transmission shiftable between a neutral and a drive condition, said apparatus comprising a single lever control adapted to be mounted on a boat remotely from the marine propulsion device and including a housing, a shaft member supported within said housing for rotation relative to said housing, a control lever connected to said shaft member for common rotation therewith relative to a neutral position, means connected to said control lever and to the throttle for controlling engine speed, a stud member fixed on said housing, a shift lever pivotally mounted on said stud member and including an elongated main body having an outer end and being operably connected with said control lever for movement between a neutral position and a drive position and operable to effect shifting of said transmission between the neutral condition and the drive condition in response to rotational movement of said control lever from the neutral position, and means on said single lever control and operably connected to said ignition system for interrupting engine ignition in response to shifting said transmission from the drive condition to the neutral condition, said ignition interruption means including an elongated aperture located adjacent said outer end and extending substantially lengthwise of said elongated main body.

3. An apparatus in accordance with claim 2 wherein said means on said control for interrupting engine ignition comprises a normally closed switch which is electrically connected with said ignition system and which is adapted to be mounted on said shift lever and positioned in spaced relation relative to said elongated aperture.

4. An apparatus in accordance with claim 3 and further including means moveably mounted on said shift lever for actuating said normally closed switch in response to movement of said shift lever from the drive position to the neutral position, wherein said actuating means comprises an actuator having an elongated main body which has a first end including an elongated aperture and which has a second end including an aperture, wherein said shift lever further includes a post fixed on said shift lever and extending through said elongated aperture of said actuator, and wherein an attachment pin extends through said aperture in said second end and through said elongated aperture in said outer end of said shift lever, said attachment pin and said post permitting lengthwise movement of said actuator relative to said shift lever.

5. An apparatus in accordance with claim 4 and further including means mounted on said shift lever for releaseably holding said actuator against movement relative to said normally closed switch, said holding means comprising a spring adapted to be mounted on said shift lever and connected to said first end of said actuator for holding said actuator in operative contact relative to said normally closed switch in response to movement of said shift lever from the neutral position to the drive position, and permitting movement of said actuator out of operative contact with said normally closed switch when said shift lever is moved from the drive position to the neutral position, and wherein said normally closed switch interrupts said engine ignition system when said actuator moves out of operative contact with said normally closed switch.

6. An apparatus in accordance with claim 5 and further including means mounted on said attachment pin for moving said actuator out of operative contact with said normally closed switch when said shift lever is moved from the drive position to the neutral position, said moving means comprising a cable pivotally mounted on said attachment pin and connected to said transmission, and wherein said cable resists the shifting movement of said shift lever, wherein said spring maintains said actuator in operative contact with said normally closed switch when said shift lever moves from the neutral position to the drive position, and wherein said actuator moves, in response to said cable resistance, away from said normally closed switch in response to movement to said shift lever from the drive position to the neutral position.

7. An apparatus for assisting shifting of a transmission in a marine propulsion device having an internal combustion engine including a throttle, and an ignition system, which transmission is shiftable between a neutral condition and a drive condition, said apparatus comprising a control device adapted to be mounted remotely from said marine propulsion device and including an engine speed control member connected to said throttle to control engine speed and a shift lever movable between a neutral position and a drive position and operably connected with said transmission for shifting said transmission between the drive position and the neutral position in response to shift lever movement between the neutral position and the drive position, means on said shift lever and connected with said ignition system for interrupting operation of said ignition system, and means movably mounted on said shift lever for actuating said interruption means in response to movement of said shift lever relative to the neutral position.

8. An apparatus for assisting shifting of a transmission in a marine propulsion device having an internal combustion engine with an ignition system, which transmission is shiftable between a neutral condition and a drive condition, said apparatus comprising a single lever control adapted to be mounted on a boat in a remote location relative to said internal combustion engine and including a housing adapted to be fixed on the boat, a shaft member supported in said housing for rotation relative to said housing, a control lever connected to said shaft member for common rotation therewith and including an outer end manipulatable by a user and moveable relative to a neutral position and a drive position, a stud member fixed on said housing, a shift lever operably connected with said transmission for shifting said transmission between the drive position and the neutral position and being pivotally mounted on said stud member and operably connected with said control lever so as to effect shifting of said transmission between the neutral condition and the drive condition in response to movement of said control lever from the neutral position to the drive position, means on said shift lever and connected with said ignition system for interrupting operation of said ignition system, and means moveably mounted on said shift lever for actuating said interruption means in response to movement of said shift lever from the drive position to the neutral position.

9. An apparatus in accordance with claim 8 wherein said shift lever has an elongated main body including first and second ends and an arm positioned between said first and second ends, and an aperture located in said first end, and wherein said stud member extends therethrough, an elongated aperture located adjacent said second end and oriented in substantially lengthwise relation relative to said elongated main body, and a post fixed on said main body and positioned intermediate said first and second ends and in substantially perpendicular relation relative to said main body.

10. An apparatus in accordance with claim 9 wherein said means on said shift lever and connected with ignition for interrupting operation of said ignition comprises a normally closed switch mounted on said arm.

11. An apparatus in accordance with claim 10 wherein said means movably mounted on said shift lever for actuating said interruption means comprises an actuator having an elongated main body with first and second ends and including an arm mounted adjacent said first end, an elongated aperture located adjacent said first end and oriented substantially lengthwise relative to said main body of said actuator, and wherein said post extends through said elongated aperture, and wherein said actuator further includes an aperture located adjacent said second end of said actuator, said aperture being disposed in registry with said elongated aperture formed in said second end of said shift lever, wherein said arm of said actuator is positioned adjacent said normally closed switch, and wherein an attachment pin extends through said elongated aperture in said second end of said shift lever and through said aperture located in said second end of said actuator.

12. An apparatus in accordance with claim 11 and further including means on said shift lever and on said actuator for holding said actuator against movement relative to said normally closed switch, said holding means comprising a spring having a first end mounted on said shift lever and having a second end mounted on said first end of said actuator.

13. An apparatus in accordance with claim 12 and further including means mounted on said attachment pin for moving said actuator out of operative contact with said normally closed switch when said shift lever is moved from the drive position to the neutral position, said moving means comprising a cable adapted to be pivotably mounted on said attachment pin and connected to said transmission and being operative, in response to movement of said shift lever from said neutral position, to shift said transmission from said neutral position, said cable resisting movement of said shift lever from said neutral position to said drive position, and wherein said actuator remains in operative contact with said normally closed switch under the influence of said spring when said shift lever moves from the neutral position to the drive position, wherein said cable, in response to movement of said shift lever from said drive position to said neutral position, moves said actuator away from said normally closed switch, and wherein said normally closed switch is operative, in response to movement of said actuator away from said normally closed switch, to interrupt engine ignition.

14. A marine propulsion device including an internal combustion engine including an ignition system, a transmission driven by said internal combustion engine and shiftable between a drive position and a neutral position, a shift lever adapted to be mounted on a boat for pivotal movement relative thereto and operably connected with said transmission for shifting said transmission between the drive position and the neutral position, a switch fixed on said shift lever for interrupting the operation of said ignition system in response to movement of said shift lever from the drive position to the neutral position, an actuator mounted on said shift lever for movement relative to said switch in response to movement of said shift lever from the drive position to the neutral position, and means mounted on said shift lever for releaseably holding said actuator against movement relative to said switch in response to movement of said shift lever from the neutral position to the drive position.

15. A marine propulsion device in accordance with claim 14 wherein said shift lever has an elongated main body including first and second ends and an arm positioned between said first and second ends, said first end of said shift lever being pivotally mounted on the boat, an elongated aperture located adjacent said second end of said shift lever and oriented lengthwise relative to said elongated main body, and a post which is fixed on said main body, which is positioned intermediate said first and second ends, and which is perpendicular in relation to said main body.

16. A marine propulsion device in accordance with claim 15 wherein said switch is mounted on said arm.

17. A marine propulsion device in accordance with claim 16 wherein said actuator has an elongated main body which has first and second ends, and which includes an arm located adjacent said first end and positioned adjacent said switch, an elongated aperture located adjacent said first end of said actuator and positioned substantially lengthwise relative to said elongated main body, wherein said post extends through said elongated aperture, an aperture located adjacent said second end of said actuator and positioned in substantial registry with said elongated aperture located on said second end of said shift lever, wherein an attachment pin extends through said elongated aperture located on said second of said shift lever and through said aperture located in said second end of said actuator, and wherein said actuator is operable, in response to movement of said shift lever from the drive position, to move from the first position wherein said arm is located in operative contact with said switch, to a second position wherein said arm is located in spaced relation thereto.

18. A marine propulsion device in accordance with claim 17 wherein said means mounted on said shift lever for releaseably holding said actuator against movement relative to said switch comprises a spring having opposite ends respectively mounted on said first end of said actuator and said shift lever.

19. A marine propulsion device in accordance with claim 18 and further including means mounted on said attachment pin for moving said actuator out of operative contact with said switch when said shift lever is moved from the drive position to the neutral position, said moving means comprising a cable operatively connecting said shifting lever with said transmission, being resistant to movement, and including a first end pivotally mounted on said attachment pin and a second end operatively connected to said transmission, and wherein said cable resists movement, and wherein said actuator, in response to movement of said shift lever from said neutral position to said drive position under the influence of said spring, remains in operative contact with said switch, and wherein said cable, in response to movement of said shift lever from said drive position to said neutral position, locates said actuator arm in spaced relation relative to said switch, thereby interrupting ignition.

* * * * *